US006267379B1

(12) United States Patent
Forrest et al.

(10) Patent No.: US 6,267,379 B1
(45) Date of Patent: Jul. 31, 2001

(54) ELECTRONICALLY INTERACTIVE LOCATION-BASED MULTIMEDIA GAME SYSTEM AND METHOD

(75) Inventors: Andrew R. Forrest, Everett; Rachel E. Carey; Alan J. Pruzan, both of Seattle, all of WA (US)

(73) Assignee: Forrest-Pruzan Creative LLC, Seattle, WA (US)

( * ) Notice: Subject to any disclaimer, the term of this patent is extended or adjusted under 35 U.S.C. 154(b) by 0 days.

(21) Appl. No.: 09/001,739

(22) Filed: Dec. 31, 1997

(51) Int. Cl.[7] ..... A63F 9/18
(52) U.S. Cl. ..... 273/431; 463/9
(58) Field of Search ..... 463/9; 273/430, 273/272, 299, 429, 273, 431, 432; 434/322

(56) References Cited

U.S. PATENT DOCUMENTS

| | | | | |
|---|---|---|---|---|
| 3,981,087 | * | 9/1976 | Sachs | 434/308 |
| 4,593,904 | * | 6/1986 | Graves | 463/9 |
| 5,180,309 | * | 1/1993 | Egnor | 434/323 |
| 5,456,607 | * | 10/1995 | Antoniak | 434/323 |
| 5,679,075 | * | 10/1997 | Forrest et al. | 463/9 |
| 5,885,087 | * | 3/1999 | Thomas | 434/323 |
| 5,915,971 | * | 6/1999 | Ramsay et al. | 434/276 |

OTHER PUBLICATIONS

"GSS–III Game Show System," product brochure by Creative Imagineering, Fort Lauderdale, FL., (1994).

* cited by examiner

*Primary Examiner*—Peter Vo
*Assistant Examiner*—John Paradiso
(74) *Attorney, Agent, or Firm*—Perkins Coie

(57) ABSTRACT

An interactive multimedia game conducted by a live human host is described. The game is played in rounds. In each round, the game poses question to teams of players. Team players select answers to each question posed and input their answers using player terminals. There may be more than one answer to the multimedia question posed, and the team players must pick all of the answers. The multimedia questions may have hints to help the team players arrive at correct multimedia answers. The multimedia questions must be answered within a given amount of time. Once time has expired, the correct multimedia answer(s) are revealed to the team players. The game also provides feedback to the teams as to whether they have selected the correct multimedia answer(s). The game awards points to the teams, with team scores determined according to the point of value of the multimedia question. The game then poses a new question. Play continues until the last question of the last round has been posed, answered, and scored. The game then announces the winning team.

29 Claims, 13 Drawing Sheets

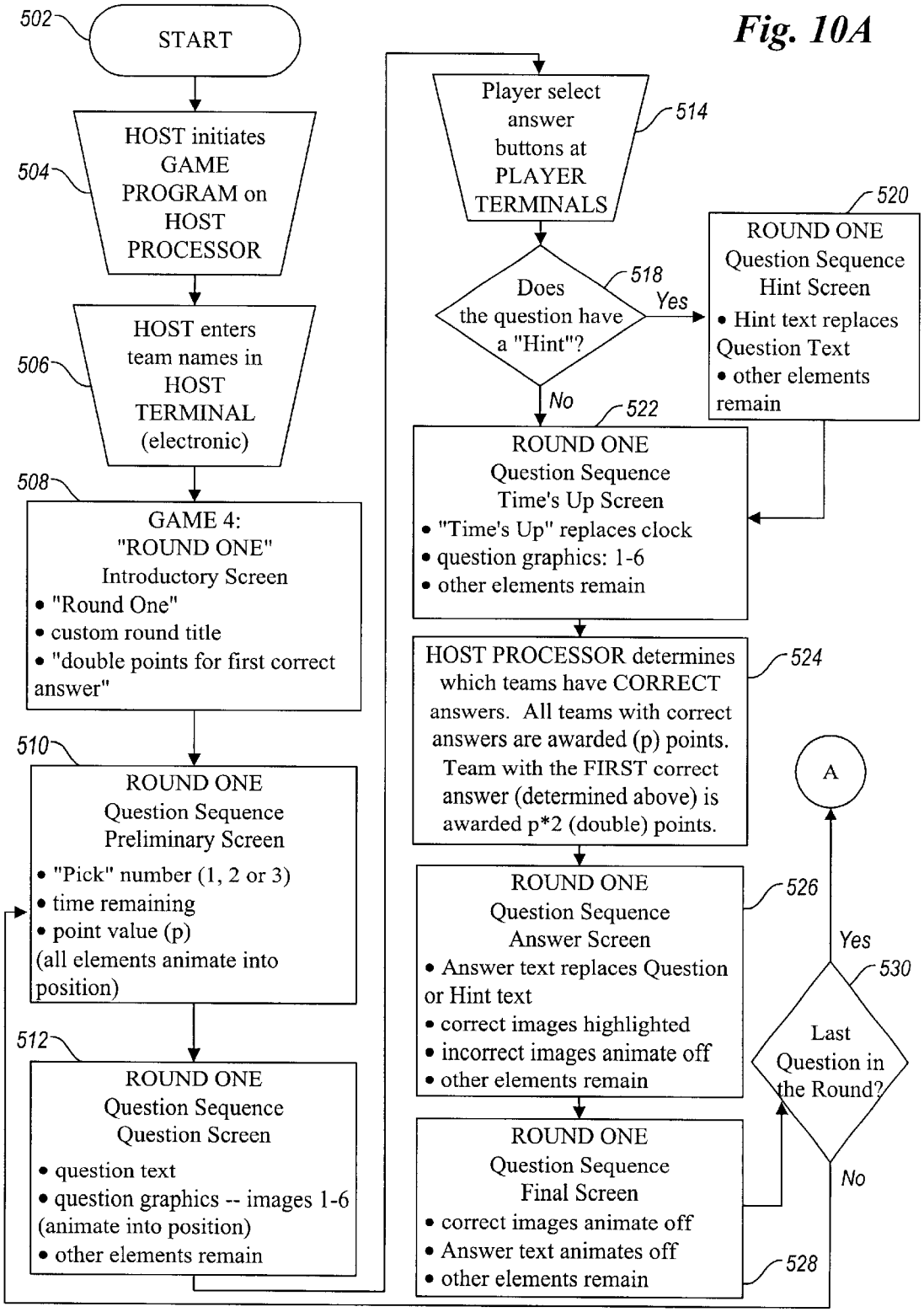
Fig. 10A
502
START
504
HOST initiates GAME PROGRAM on HOST PROCESSOR
506
HOST enters team names in HOST TERMINAL (electronic)
508
GAME 4: "ROUND ONE" Introductory Screen
• "Round One"
• custom round title
• "double points for first correct answer"
510
ROUND ONE Question Sequence Preliminary Screen
• "Pick" number (1, 2 or 3)
• time remaining
• point value (p)
(all elements animate into position)
512
ROUND ONE Question Sequence Question Screen
• question text
• question graphics -- images 1-6 (animate into position)
• other elements remain
514
Player select answer buttons at PLAYER TERMINALS
518
Does the question have a "Hint"?
Yes
No
520
ROUND ONE Question Sequence Hint Screen
• Hint text replaces Question Text
• other elements remain
522
ROUND ONE Question Sequence Time's Up Screen
• "Time's Up" replaces clock
• question graphics: 1-6
• other elements remain
524
HOST PROCESSOR determines which teams have CORRECT answers. All teams with correct answers are awarded (p) points. Team with the FIRST correct answer (determined above) is awarded p*2 (double) points.
526
ROUND ONE Question Sequence Answer Screen
• Answer text replaces Question or Hint text
• correct images highlighted
• incorrect images animate off
• other elements remain
528
ROUND ONE Question Sequence Final Screen
• correct images animate off
• Answer text animates off
• other elements remain
530
Last Question in the Round?
Yes
No
A

SCORE BOARD

| TEAM NAME | POINTS |
|---|---|
| TEAM A | TEAM A'S POINTS |
| TEAM B | TEAM B'S POINTS |
| TEAM C | TEAM C'S POINTS |
| ⋮ | ⋮ |
| ⋮ | ⋮ |
| TEAM Z | TEAM Z'S POINTS |

116

*Fig. 11*

ELECTRONICALLY INTERACTIVE LOCATION-BASED MULTIMEDIA GAME SYSTEM AND METHOD

TECHNICAL FIELD

The present invention relates to the field of interactive entertainment systems and methods for using such systems.

BACKGROUND OF THE INVENTION

Conventional interactive games of the game show or quiz show variety typically pose trivia questions to players. In these games, the multimedia question content is usually text-based and the multimedia question structure is often multiple choice. The text-based games do not include graphics. Moreover, if the multimedia questions posed are multiple choice, there is usually only one correct multimedia answer to each question. For example, NTN Trivia and You Don't Know Jack use text-based multiple choice questions having only one correct multimedia answer.

Some conventional game show or quiz show interactive games pose questions to individual players who compete against each other. For example, NTN Trivia is designed for up to twenty players, but all of the players are playing as individuals in competition with each other. Similarly, You Don't Know Jack is designed for three individuals to play against one another.

A few conventional game show or quiz show interactive games may be designed for team play. However, these games generally allow only one player per team to play at a time. For example, the so-called team play of NTN Trivia allows only one player per team to play at a time. Moreover, most conventional game show or quiz show interactive games usually are restricted to being played without any host/player interaction. This is the case with NTN Trivia, for example. It can be appreciated therefore that what is needed is an electronically interactive game that at least poses questions in more than textual form, that features host/player interaction, and which accommodates team play.

SUMMARY OF THE INVENTION

Presented herein is a system and method to play an electronically interactive multimedia game that overcomes the limitations associated with conventional game show or quiz show interactive games and provides additional benefits. One embodiment uses multimedia-based (i.e., text, audio, graphical images, etc.) questions that may have a plurality of answers for each question. This embodiment also poses the multimedia questions to teams of players. The team of players simultaneously play for the success of their particular teams by selecting answers to the multimedia question posed. The players on each team collaborate with each other to come up with an overall correct multimedia answer to the multimedia question. Because the multimedia questions and multimedia answers are more complex than in conventional game show or quiz show interactive games, the players must pool their knowledge to get the overall correct answer and advance in the game. The interactive multimedia game system and method challenges players to select, match, combine, and associate fun images. Because the game works pictorially, it is accessible to a wider group of players. This embodiment also may be led by a live human host who conducts the game and interacts with the players and teams. The live human host may pose bonus questions in non-electronic format, in an effort to break a tie, for example, and may award prizes to the winning team.

The interactive multimedia game may be played in a location-based facility. The location-based facility may include a host that conducts the game. The host may include a live human host and a computer host.

The location-based facility also may include a multimedia unit. The multimedia unit may include a processor, a screen (s) for displaying text and graphics, and an audio system for playing music and sound effects, for example, as well as for amplifying voices.

At the start of the interactive multimedia game the live human host may organize a plurality of teams to play the game. Each team includes a plurality of players. The location-based facility thus also may include a plurality of player terminals around which the plurality of teams gather. Each player terminal is accessible to each player on each team simultaneously.

The interactive multimedia game may be played in rounds. In one embodiment, the interactive multimedia game includes a first round, a second round, a third round, or a "lightning round." In each round, the interactive multimedia game poses a multimedia question to the plurality of teams and provides a plurality of possible multimedia answers to the multimedia question. The plurality of teams must pick one, two, or three multimedia answers from among the plurality of possible multimedia answers. In one embodiment the multimedia screen(s) displays the multimedia question and the plurality of possible multimedia answers to the multimedia question.

Unlike conventional game show or quiz show interactive games, the multimedia question and the plurality of possible multimedia answers to the multimedia question may be in text, audio, and graphic form. The text may be "question text," "hint text," or "answer text." The possible multimedia answers to the multimedia question are termed "question graphics."

Of course, a particular type of question is not required by the present invention. Rather, the multimedia questions may be any of a variety of types. For example, in one embodiment, the multimedia question may be an "identification question," which has one, two, or three question graphics that fit the question text. In another embodiment, the multimedia question may be a "matching question," which matches two question graphics, for example, based on the question text. Alternatively, the multimedia question may be an "oddball question" that asks which question graphic does not belong in the plurality of question graphics. In another embodiment, the multimedia question may be a "linking question," in which there exists a relationship between two or three question graphics, for example. There may be "compound word" questions in which players combine two or more question graphics to form a compound word or phrase that best fits the question text. One embodiment includes a "sequencing question," which requires the possible multimedia answers to be selected in a particular sequence. There may also be "polling questions," which ask factual questions and then calculate the responses as in a survey rather than a quiz.

The interactive multimedia game may provide a plurality of player terminals to enable the plurality of players to substantially simultaneously select answer(s) from among the plurality of possible multimedia answers displayed on the multimedia screen. The player terminals may have a plurality of player input devices that correspond to the plurality of question graphics. In one embodiment, the player input devices may be push buttons. The player terminals may also) include a plurality of signal lights that indicate whether the particular team selected the correct multimedia answer(s).

In one embodiment, the player terminals may include an audio system to play the digital audio of the game, as well as to amplify human voices. The player terminals also include computers or processors to process player inputs and to communicate with the computer host.

The player terminals may also include a display unit and keyboard or other player input device to receive and display a unique team name for each team.

Further features and advantages as well as the structure and operation of various embodiments are described in detail below.

BRIEF DESCRIPTION OF THE FIGURES

The invention described herein is best understood by reference to the figures, where elements with like reference numbers indicate identical or functionally similar elements.

FIGS. 10A, 10B, and 10C is a flow diagram of one method of playing an interactive multimedia game under the facility of FIG. 1.

FIG. 11 is a block diagram of the multimedia screen of FIG. 3 displaying a scoreboard.

DETAILED DESCRIPTION OF THE INVENTION

An electronically interactive multimedia game ("game") is described herein. In the following description, numerous specific details and methods are set forth in order to provide a full understanding of the invention. One skilled in the relevant art, however, will readily recognize that the invention can be practiced without one or more of the specific details, or with other methods. In other instances, well-known structures or operations are not shown in detail in order to avoid obscuring the invention.

At a high level, the game is played in rounds. In each round, the game poses a question to teams of players. Team players select answers to each question posed and input their answers using player terminals. There may be more than one answer to the multimedia question posed, and the team players must pick all of the answers. The multimedia questions may have hints to help the team players arrive at correct multimedia answers. The multimedia questions must be answered within a given amount of time. When time has expired, the correct multimedia answer(s) are revealed to the team players. The game also provides feedback to the teams as to whether they have selected the correct multimedia answer(s). The game awards points to the teams, with team scores determined according to the point value of the multimedia question. The game then poses a new question. Play continues until the last question of the last round has been posed, answered, and scored. The game then announces a winning team.

I. Example Environment

Figure 1:
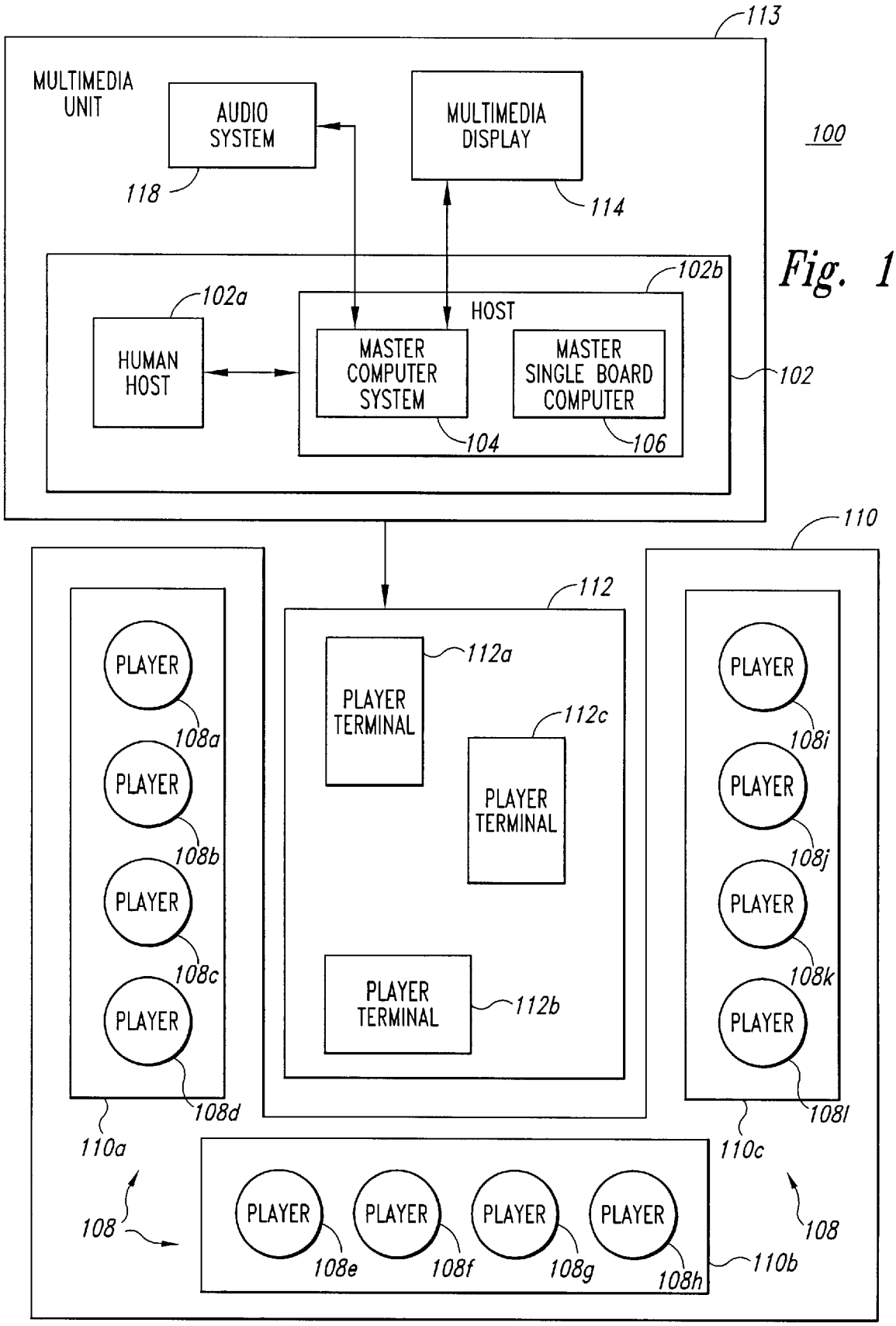
FIG. 1 is a high level block diagram of a location-based entertainment facility suitable for implementing one embodiment of the present invention.

FIG. 1 is a high level block diagram of a location-based entertainment facility 100 suitable for implementing one embodiment of the interactive multimedia game. The location-based entertainment facility 100 may be a defined space such as an outdoor area or one or more rooms in a building. The location-based entertainment facility 100 may include non-specific areas, such as different nodes in a computerized communication network or sites/pages on the Internet or in "cyberspace." The location-based entertainment facility 100 also may be as small as a single room or as large as a multi-state geographic region.

One embodiment of the game is conducted by a host 102 located within the location-based entertainment facility 100. The host 102 may include a computer, as represented by the computer host 102*a*. The computer host 102*a* may be implemented in computer software run on a computer. Alternatively, the computer host 102*a* may be implemented using hardware or a combination of hardware and software, and may be implemented in a computer system or other processing system. In an embodiment where the invention is implemented using software, the software may be stored on a computer program product (such as an optical disk, a magnetic disk, a floppy disk, etc.) or a program storage device (such as an optical disk drive, a magnetic disk drive, a floppy disk drive, etc.). The multimedia interactive game may also be implemented using a game cartridge, such as a floppy disk, a read only memory (ROM) cartridge, or a compact disk read only memory (CD-ROM), for example.

For example, the computer host 102*a* may include a master computer system 104, which typically includes a processor, a data storage system, and audio/video systems. In one embodiment, the master computer system 104 may be implemented using a Pentium processor available from Intel, a well known two gigabyte hard drive, 256 megabytes of a well known random access memory (RAM), a well known four megabyte video card, and a well known thirty-two bit sound card.

The host computer 102*a* also may include a master single computer board 106, which may be implemented using a personal computer. After reading this description, it will become apparent to a person skilled in the relevant art how to implement the computer host 102*a* using various computer systems and architectures.

One feature of the present invention is that the host 102 may also include a live human, as represented by the live human host 102*b*. In contrast to conventional interactive games, the live human host 102*b* works in conjunction with the computer host 102*a* to conduct the interactive multimedia game, as described below.

The host 102 interacts with a plurality of players 108, as represented by the players 108*a* through 108*l*. In one embodiment, the players 108 may be patrons of the location-based entertainment facility 100. In another embodiment, some of the players may be patrons of the location-based entertainment facility 100, while other players may be playing the interactive multimedia game via an Internet connection between the worldwide web and the location-based facility 100. The interactive multimedia game may also be played in "cyberspace." Alternatively, some of the players may be playing the interactive multimedia game via a television connection between their homes and the location-based facility 100. Of course, the physical location of the players is not important for the present invention.

The host 102*b* facilitates grouping the players into teams 110. Each player 108 plays simultaneously and should cooperate for the success of his/her respective team 110. Thus, if each of the teams may be represented by the teams 110*a*, 110*b*, and 110*c*, then the players 108*a*–108*d* play simultaneously and cooperate for the success of the team 110*a*, the players 108*e*–108*h* play simultaneously and cooperate for the success of the team 110*b*, and the players 108*i*–108*l* cooperate for the success of the team 110*c*. In so doing, the players 108*e*–108*h* collaborate with each other to come up with an overall correct multimedia answer to the multimedia question. This is because the multimedia questions and multimedia answers are more complex than in conventional game show or quiz show games, as is described in greater detail below. In one embodiment, the game may be played by individuals. However, the interactive multimedia game is designed for team play. While the present invention contemplates any number of teams, for purposes of explanation, only three teams are described.

The host 102 may assign to each team a player terminal 112. For example, the host 102 may assign the team 110*a* a player terminal 112*a*, the team 110*b* a player terminal 112*b*, and the team 110*c* a player terminal 112*c*. In one embodiment, the team 110*a* gathers around the player terminal 112*a*, the team 110*b* gathers around the player terminal 112*b*, and the team 110*c* gathers around the player terminal 112*c* and the teams compete against each other.

Figure 2:
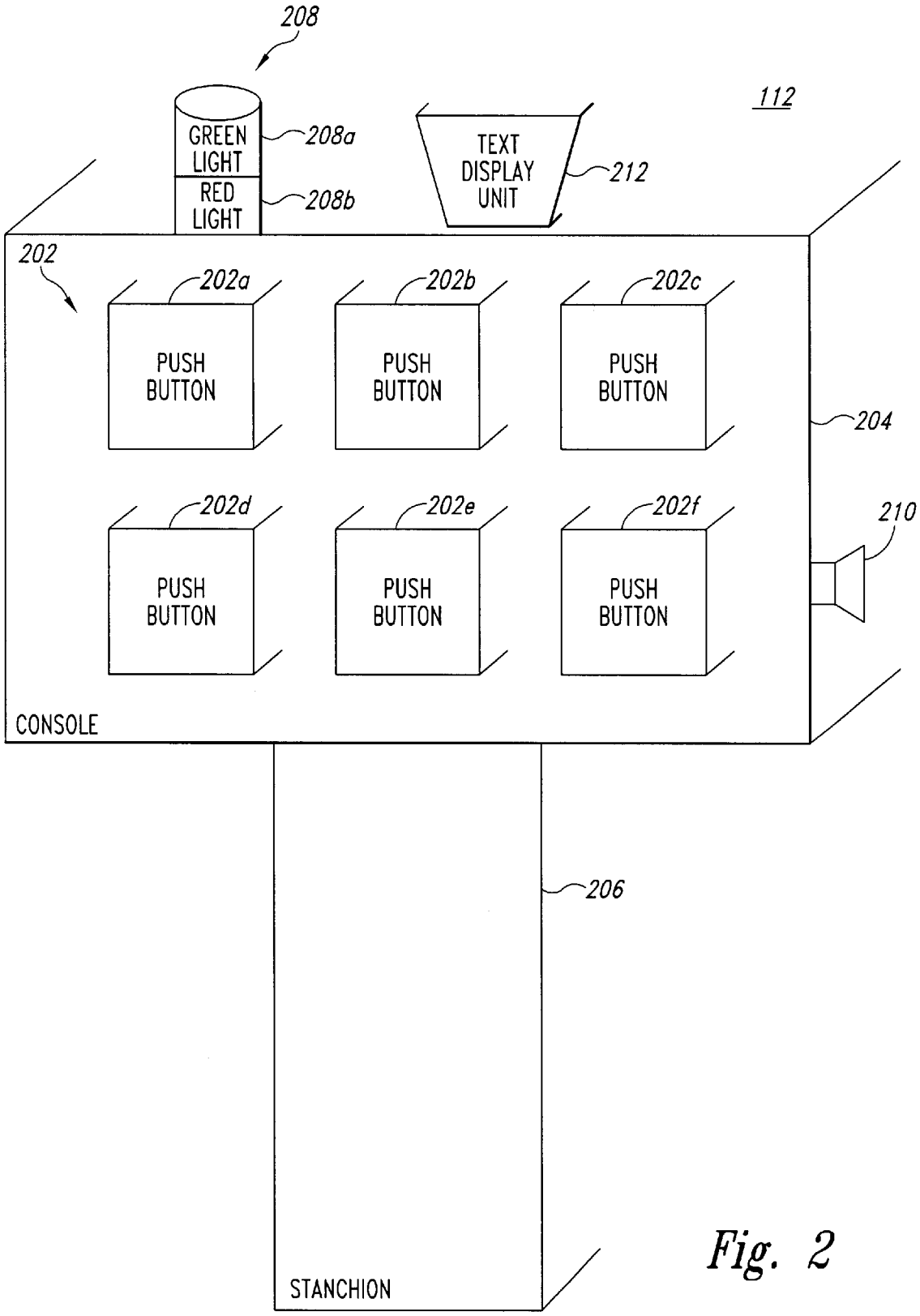
FIG. 2 is a block diagram of a player terminal suitable for use in the facility of FIG. 1.

FIG. 2 illustrates one embodiment of the player terminal 112. Each player terminal 112 may include electronic controls to allow electronic interaction between the player terminal and the master computer system 104 As FIG. 2 illustrates, the electronic controls may include six electronic push buttons 202 that provide tactile interactivity. For example, a plurality of push buttons 202*a* through 202*f* may be arranged in a two-by-three horizontal array. Each push-button 202 may be a different color to distinguish each push-button 202 as a separate control. Each push-button 202 may illuminate when pressed during the game. A specific number of push buttons 202 or a particular distinguishing technique are not important for the present invention, and those skilled in the art will understand that any number of push buttons 202 and distinguishing techniques may be used.

The plurality of push buttons 202 may be located on a console 204. For example, the push buttons 202*a* through 202*f* may be positioned at a slight angle on the console 204 to facilitate operation by any one of the plurality of players 108 or a team 110 assigned to the particular player terminal 112.

The console 204 may rest on a stanchion 206, which is at a height that is suitable for operation by a player 108 in a standing position. In one embodiment, the stanchion 206 accommodates the use of cables and other physical interconnections between each player terminal 112 and the host 102.

Each player terminal 112 may provide visual feedback to the teams 110. Recall that the host poses a question and team players select answer(s) to the multimedia question posed. Each player terminal 112 thus may include a plurality of signal lights 208 to indicate whether a team 110 has selected a correct or an incorrect multimedia answer. For example, if a correct multimedia answer has been selected, a green light 208*a* may illuminate. On the other hand, when an incorrect multimedia answer has been selected, a red light 208*b* may illuminate. Of course, those skilled in the relevant art will appreciate that a particular type of signal light 208 is not required by the present invention. Instead, various types of signal lights 208 may be used, including those that blink, rotate, etc.

Each player terminal 112 also may provide audio feedback to the teams 110. Each player terminal 112 thus may include an audio system 210 to process audio signals (sound effects, music, etc.). The audio system 210 may include an amplifier (not shown) to amplify the voice of the human host 102*b*. The amplifier also may amplify digital audio of the game. The audio system 210 also may include a speaker to play sound effects, music, etc. For example, the audio system 210 may play one sound effect when a correct multimedia answer has been selected by a team player, and play a different sound effect when an incorrect multimedia answer has been selected. Implementation of amplifiers and speakers is well known.

Each player terminal 112 also may display text and/or graphics to the live human host 102*b*, as well as to the other teams 110. As such, each player terminal 112 may include a display unit 212 and keyboard (not shown) or other input device (not shown), which enable a particular team to type and display a unique team name. In one embodiment, the display unit 212 may be a Magna Doodle writing toy mounted to the front of each player terminal 112.

The player terminals 112 may be implemented in computer software run on a computer. Alternatively, the player terminals 112 may be implemented using hardware or a combination of hardware and software, and may be implemented in a computer system or other processing system. In an embodiment where the invention is implemented using software, the software may be stored on a computer program product (such as an optical disk, a magnetic disk, a floppy disk, etc.) or a program storage device (such as an optical disk drive, a magnetic disk drive, a floppy disk drive, etc.).

Each player terminal 112 is functionally identical, and in one embodiment, may include a computer (not shown) to process input signals from the push buttons 202, communicate with the computer host 102*a*, accept data from the computer host 102*a*, and send outputs to the signals lights 208 and to the audio system 210. The computer host 102*a* may be directly connected to the player terminals or be multiplexed over fewer numbers of lines. Moreover, the computer host 102*a* continually polls the status of the push buttons 202. The computer host 102*a* may also generate the appropriate text, audio and video to be sent to the player terminals. A particular type of computer is not essential to the operation of the player terminal 112. Moreover, it will be apparent to those skilled in the relevant art that the player terminal 112 may be implemented in a variety of environments, including a laptop or desktop computer environment utilizing a keyboard and/or a mouse input. The laptop or desktop computer environment may also include a suitable video display and/or audio for enhanced feedback.

Referring back to FIG. 1, the location-based entertainment facility 100 also includes a multimedia unit 113, which features text, graphical images, computer-animated graphics, sound effects, and music, for example. The multimedia unit 113 includes a multimedia display 114 and an audio system 118 to implement these functions, as is described in greater detail below.

The multimedia display 114 is large enough and is positioned within the location-based entertainment facility 100 to be easily viewed by all players 108 as well as any audience members present. While the present invention contemplates the use of more than one multimedia display, for purposes of explanation, only one multimedia display 114 will be described. In one embodiment, the multimedia display 114 is implemented using a Chisolm Galaxy V470 LCD video/data projector available from HB Communications, Inc.

Figure 3:
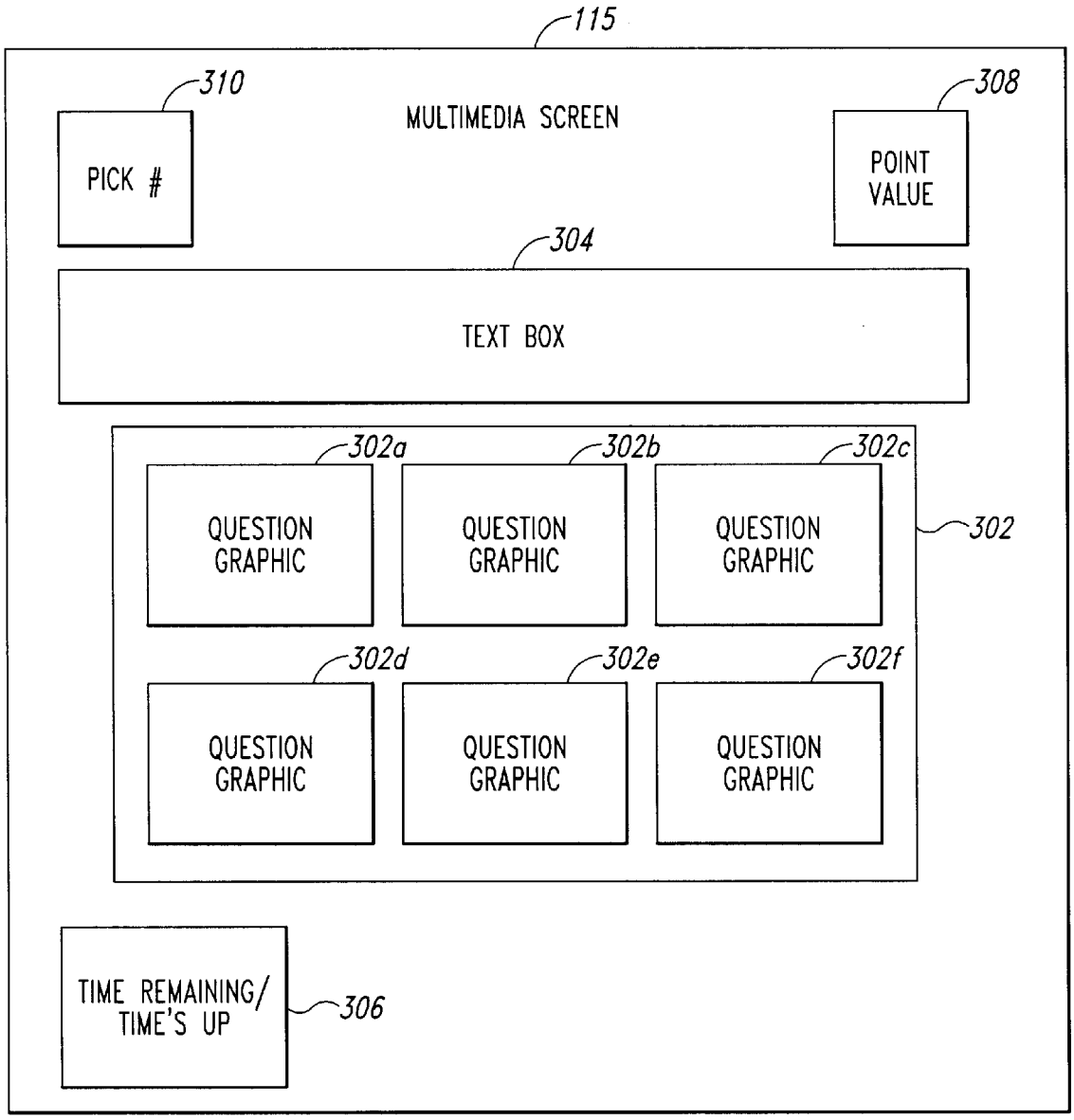
FIG. 3 is a block diagram of material that would appear on a multimedia screen suitable for use with the facility of FIG. 1.

FIG. 3 illustrates the multimedia display 114 in greater detail. Recall that the interactive multimedia game according to one embodiment is played in rounds during which a multimedia question is posed to each of the players 108. The multimedia display 114 thus includes a multimedia screen 115 with a question graphics box 302 to display photographic images, portraits, stylized text, simple line drawings, geometric shapes, color fields, etc. Moreover, each question graphic, video or animation clip may appear and disappear on the multimedia screen 115 via a variety of different animation effects. For example, in one embodiment, the question graphics box 302 includes six square question graphics 302*a*, 302*b*, 302*c*, 302*d*, 302*e*, and 302*f* positioned in a two-by-three horizontal array. The array corresponds to the position of the push buttons 202*a* through 202*f* on each player terminal 112.

The multimedia screen 115 also includes a text box 304, which may display a sentence or a phrase. For example, the text box 304 may display "question text," which is a sentence or phrase that creates a relationship among two or more of the question graphics 302*a* through 302*f*. The text box 304 also may display "hint text." "Hint text" provides more details or more information leading to the correct multimedia answer(s).

The players 108 select answers to each question and input their responses using the push buttons 202 on their respective player terminals 112 within a given amount of time. The multimedia screen 115 thus also may include a "time remaining/time's up" box 306 to indicate how much time remains to answer the multimedia question and to indicate that the time to answer has, expired.

Once time has expired as indicated by the time remaining box/time's up 306, the correct multimedia answer is revealed. The text box 304 thus may also display "answer text." "Answer text" is text that explains or comments on the correct multimedia answer(s) to a question previously posed. The players 108 may receive feedback as to whether they have gotten the answer correct or incorrect. In one embodiment, the feedback may be animated effects that encircle or highlight the correct individual question graphic 302. Thus, the players receive feedback from the multimedia screen 115 as well as feedback from their respective player terminal 112, as described above.

The multimedia screen 115 also includes a point value box 308 which displays the number of points that a particular question is worth. After the time for responding to the multimedia question has expired, points are awarded electronically to the individual teams 110. Each team 110 has an opportunity to score points. That is, not merely the fastest player receives points. In this embodiment, the fastest team is rewarded with a higher score, but all teams may answer and score accordingly.

The points awarded for overall correct multimedia answers may be multiples of the number in the point value box 308. For example, every team 110 with the correct multimedia answer selected at the end of the multimedia question period (when there are zero seconds remaining on the "time remaining/time's up" box 306) receives the number of points displayed in the point value box 308. The exception is for the first team 110 to select the correct multimedia answer, which receives double of the point value displayed in the point value box 308 for a particular question. The team 110 to answer the multimedia question in the shortest amount of time may also receive one and one-half the point value displayed in the point value box 308 for a particular question.

One feature of the above-described embodiment is that it allows for questions that are more challenging than those posed by conventional interactive games. This is because the players 108 may select more than one answer to the multimedia questions posed. For example, each team 110 may have to select one, two or three different question graphics 302, requiring teamwork to recognize relationships between things, to see matches, to recall cultural trivia, etc. The interactive multimedia game thus includes sub-game routines to write questions that are made of multiple parts. One player may know half the answer and another player may know the other half of the overall correct answer. According to this scenario, the overall correct answer is obtained only by collaboration. As such, the multimedia screen 115 includes a pick number box 310 to indicate how many answers a team 110 must select to get the overall correct multimedia answer to the multimedia question. In one embodiment, the pick number 310 may be up to three.

There may be any of a variety of question types. Question types include "identification questions," which allow the players 108 on a team 110 to select one, two, or three question graphics, depending on the pick number that is displayed in the pick number box 310, that fits the "question text" or "hint text" that appears in the text box 304.

Figure 4:
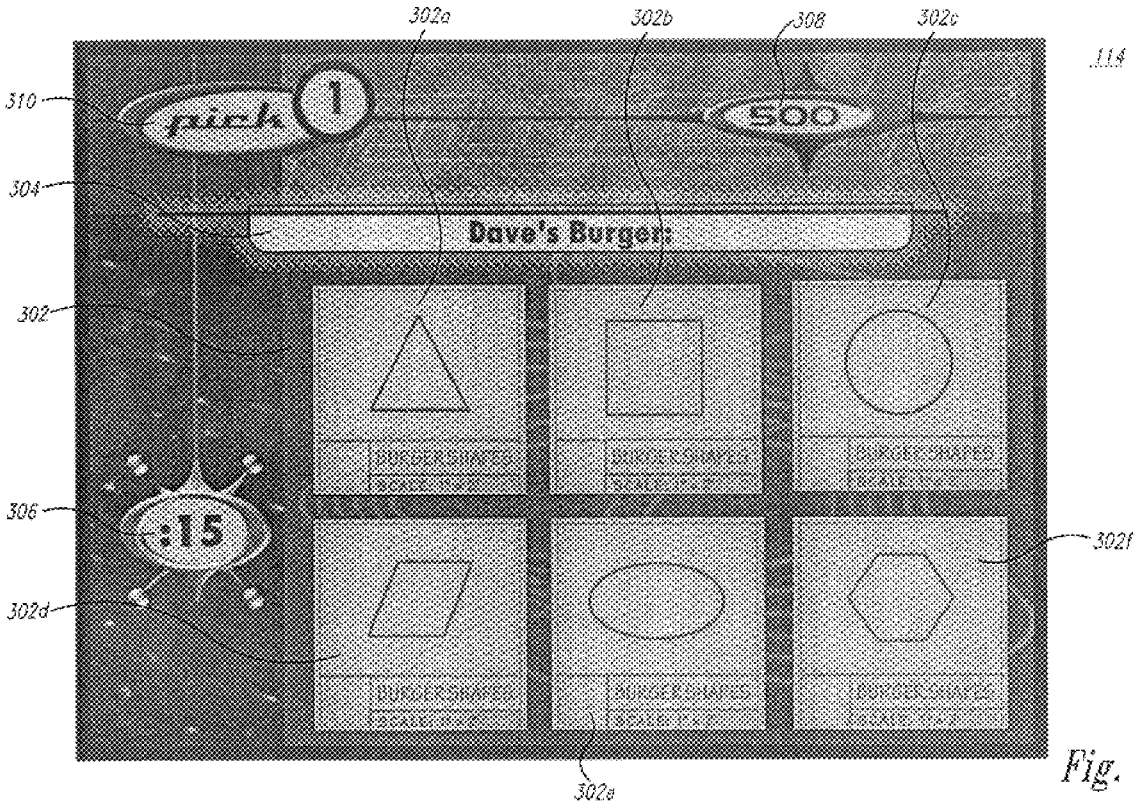
FIG. 4 is a block diagram of the multimedia screen of FIG. 3 displaying an "identification question."

For example, FIG. 4 depicts the text "Dave's Burger:" in the text box 304. According to the pick number box 310, the players 108 have to select one of the six question graphics in the question graphics box 302 that is identified with "Dave's Burger." According to the time remaining/time's up box 306, the players 108 have fifteen seconds in which to make their selections. The players 108 must choose from a "triangle shape" as the question graphic 302*a*, a "square shape" as the question graphic 302*b*, a "circle shape" as the question graphic 302*c*, a "parallelogram shape" as the question graphic 302*d*, an "ellipse shape" as the question graphic 302*e*, and a "hexagon shape" as the question graphic 302*f*. The correct multimedia answer is that "Dave's Burger" is identified with the "square shape" depicted in the question graphic 302*b* because the hamburgers offered at WENDY'S® restaurant are square, and Wendy's® is owned by "Dave." According to the "point value" box 308, the overall correct multimedia answer is worth 500 points.

Figure 5:
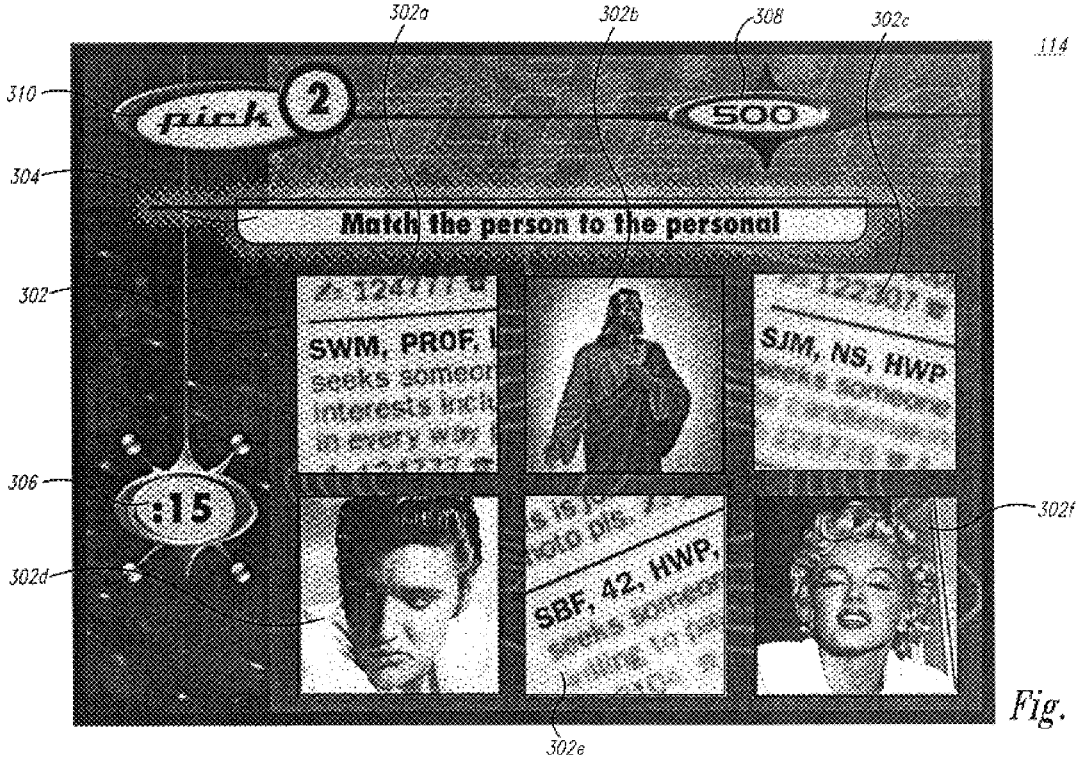
FIG. 5 is a block diagram of the multimedia screen of FIG. 3 displaying a "matching question."

"Matching" questions permit the players 110 to choose two question graphics 302 that go together based on the "question text" or "hint text" that appears in the text box 304. For example, FIG. 5 depicts the text "Match the Person to the Personal" in the text box 304. According to the pick number box 310, the players 108 have to select two of the six question graphics in the question graphics box 302 that are identified with "Match the Person to the Personal." According to the time remaining/time's up box 306, the players 108 have fifteen seconds in which to make their selections. The players 108 must select a picture and match it to a personal advertisement. The choices are, for example, "SWM, PROF seeks . . . " as the question graphic 302*a*, a picture of Jesus as the question graphic 302*b*, "SJM, NS, HWP, seeks . . . " as the question graphic 302*c*, a picture of Elvis as the question graphic 302*d*, "SBF, 42, seeks . . . " as the question graphic 302*e*, or a picture of Marilyn Monroe as the question graphic 302*f*. The correct multimedia answer is to match the Jesus question graphic 302*c* with the "SJM, NS, HWP, seeks . . . " question graphic 302*e* because Jesus was a single Jewish male, and neither Marilyn Monroe nor Elvis was. According to the "point value" box 308, the overall correct multimedia answer is worth 500 points.

Figure 6:
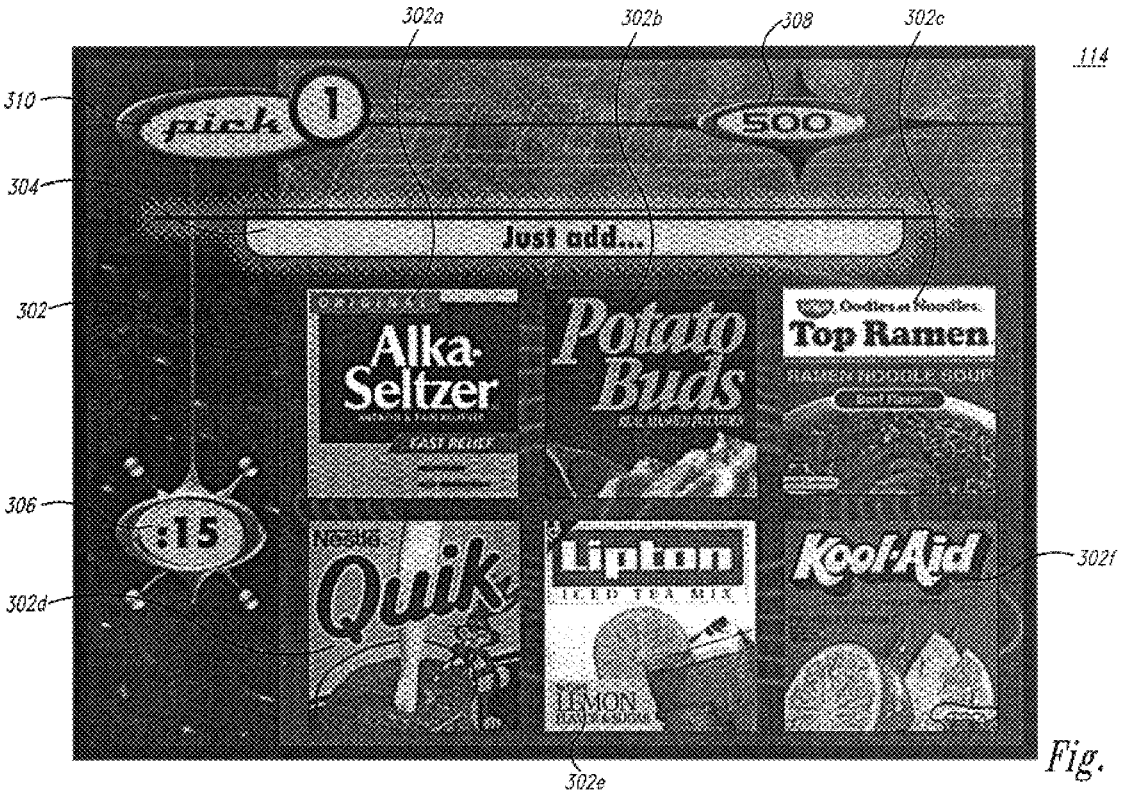
FIG. 6 is a block diagram of the multimedia screen of FIG. 3 displaying an "oddball question."

"Oddball" questions allow the players 110 to select which question graphic does not belong in the group of question graphics 302 as a whole, along with the "question text" or "hint text" that appears in the text box 304. For example, FIG. 6 depicts the text "Just Add . . . " in the text box 304. According to the pick number box 310, the players 108 have to select one of the six question graphics that does not fit wit the other question graphics and the question text, According to the time remaining/time's up box 306, the players 108 have fifteen seconds in which to make their selections. The players 108 must choose from ALKA-SELTZER® as the question graphic 302*a*, POTATO BUDS® as the question graphic 302*b*, TOP RAMEN® noodle soup as the question graphic 302*c*, NESTLE'S QUIK® as the question graphic 302*d*, LIPTON® Iced Tea Mix as the question graphic 302*e*, and KOOL-AID® as the question graphic 302*f*. The overall correct multimedia answer is the NESTLE'S QUIK® question graphic 302*c* because with POTATO BUDS®, POTATO BUDS®, TOP RAMEN® noodle soup, LIPTON® Iced Tea, and KOOL-AID®, you "just add" water, while with NESTLE'S QUIK® you "just add" milk. According to the "point value" box 308, the overall correct multimedia answer is worth 500 points.

Figure 7:
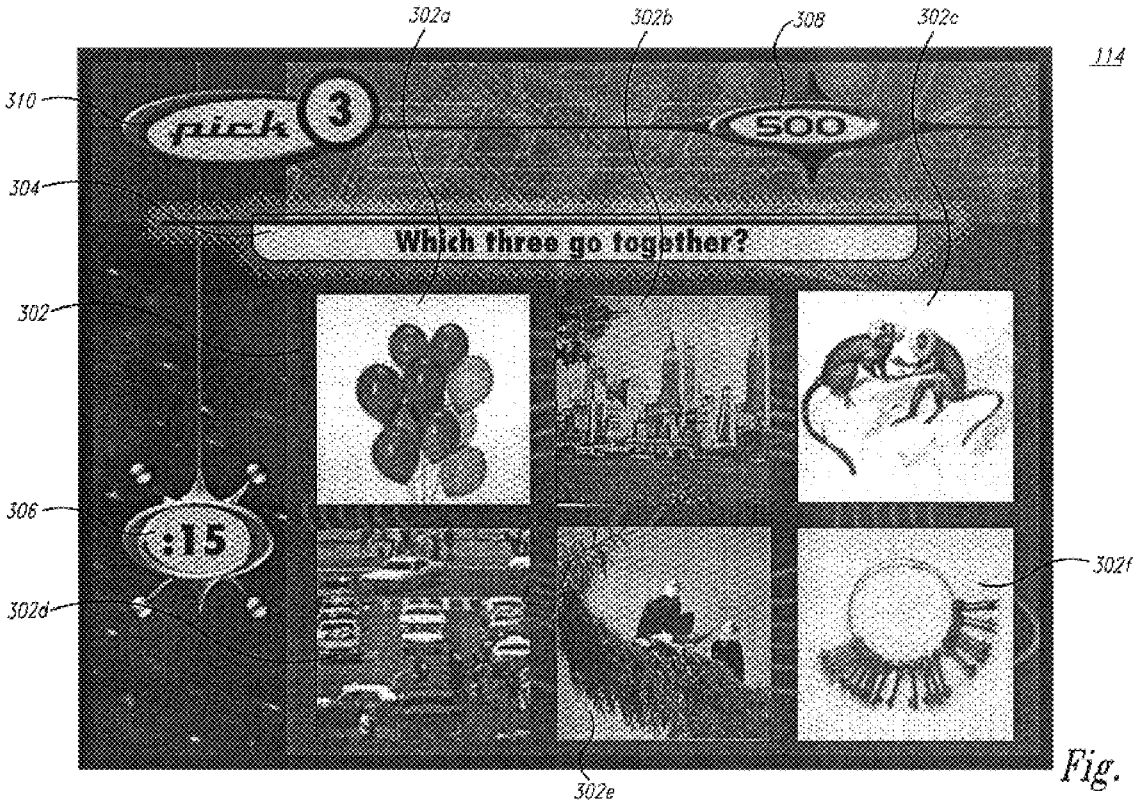
FIG. 7 is a block diagram of the multimedia screen of FIG. 3 displaying a "linking question."

"Linking" questions allow the players 108 to discover a relationship between two or three question graphics 302 depending upon the pick number displayed in the pick number box 310 and based on the text displayed in the text box 304. For example, FIG. 7 depicts the text "Which three go together?" in the text box 304. According to the pick number box 310, the players 108 have to select three of the six question graphics that are linked together. According to the time remaining/time's up box 306, the players 108 have fifteen seconds in which to make their selections. The players 108 must choose from "balloons" as the question graphic 302*a*, "buildings" as the question graphic 302*b*, "monkeys" as the question graphic 302*c*, "cars" as the question graphic 302*d*, "eagles" as the question graphic 302*e*, and "keys" as the question graphic 302*f*. The overall correct multimedia answer is the monkeys question graphic 302*c*, the cars question graphic 302*d*, and the eagles question graphic 302*e* because THE MONKEES®, THE CARS®, and THE EAGLES® are all rock bands. According to the "point value" box 308, the overall correct multimedia answer is worth 500 points.

Figure 8:
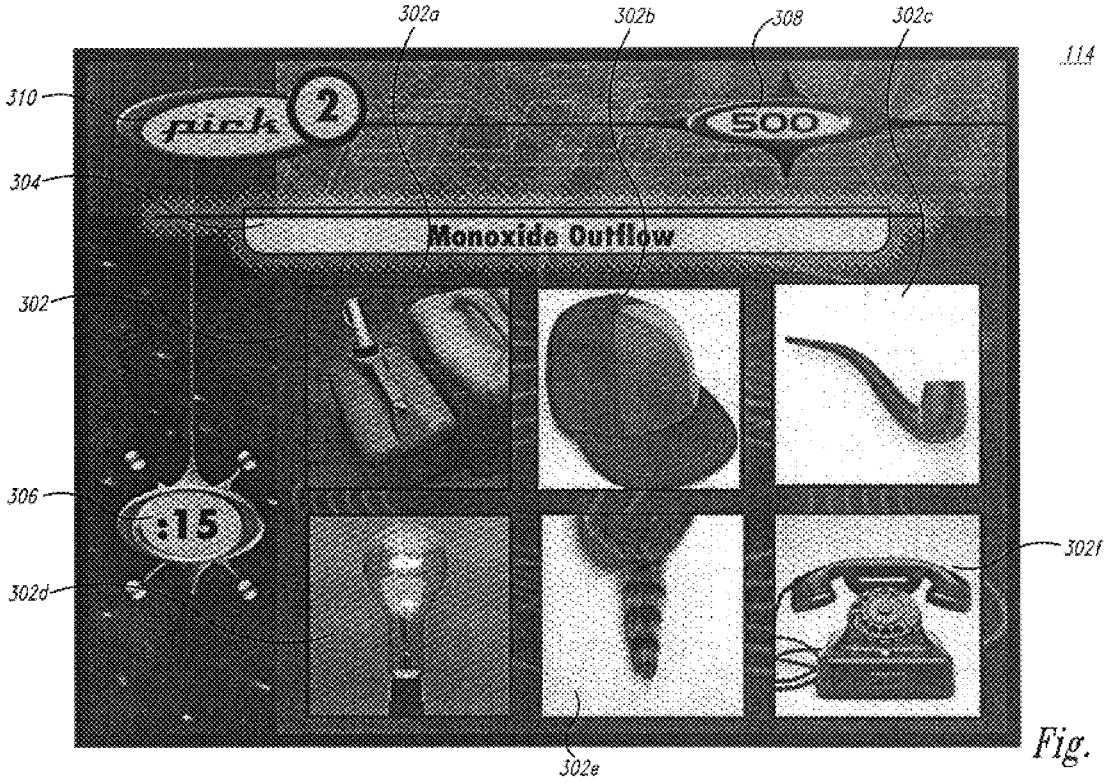
FIG. 8 is a block diagram of the multimedia screen of FIG. 3 displaying a "compound word question."

According to "compound word" questions, players put together two (or three) question graphics to form a compound word or phrase that best fits the text in the text box 304. For example, FIG. 8 depicts text "Monoxide Outflow" in the text box 304. According to the pick number box 310, the players 108 have to select two of the six question graphics to form a compound word. According to the time remaining/time's up box 306, the players 108 have fifteen seconds in which to make their selections. The players 108 must choose from a "gasoline can" as the question graphic 302*a*, a "baseball cap" as the question graphic 302*h*, a "tobacco pipe" as the question graphic 302*c*, a "light bulb" as the question graphic 302*d*, a "raccoon tail" as the question graphic 302*e*, and a "telephone" as the question graphic 302*f*. The overall correct multimedia answer is the raccoon tail question graphic 302*e* and the tobacco pipe question graphic 302*c* because they form the compound word "tailpipe," which is a source of "Monoxide Outflow." According to the "point value" box 308, the overall correct multimedia answer is worth 500 points.

Other question types include "sequencing" questions, which may require players to press the push buttons 202 in a particular sequence in order to get the correct multimedia answer. For example, the question graphics 302 may include pictures of six different models of Ford cars, wherein the players 108 have to select the cars in chronological order of manufacture.

"Polling" questions may ask a factual question about the players 108 or the teams 110 and then calculate the responses as in a survey rather than as in a quiz. Points awarded for each question may depend on whether the players select answers that were selected by a majority or minority of those polled. This type of question allows for follow-up questions based on the results of the survey.

Referring to FIG. 11, the location-based facility 100 also may include a scoreboard 116 to display the scores for each team. In one embodiment, the scoreboard 116 displays the scores from highest to lowest. Alternatively, the scoreboard 116 displays the scores from lowest to highest. Alternatively still, the scoreboard 116 displays only the score of the winning team 110.

As described above, the multimedia unit 113 includes an audio system 118, which displays text and graphics. For example, the audio system 118 displays "question text," "question graphics," "hint text," and "answer text to the teams 110 of players 108. The audio system 118 also replays the digital audio of the game (e.g., music, sound effects, etc.) and amplifies human voices. The audio system 118 includes an audio and video playback device (not shown), such as a computer or video laser disk player with an integrated or a separate keypad.

A feature of the game of the present invention is the live human host 102*b* who interacts with the players 108 and the computer host 102*a*. At any time, the human host 102*b* may ask the players 108 a question. This poses an added challenge not available with conventional systems. For example, the live questions may be used as tie breakers or to determine the winning team in a very close game.

II. Operation of One Embodiment

Figure 9:
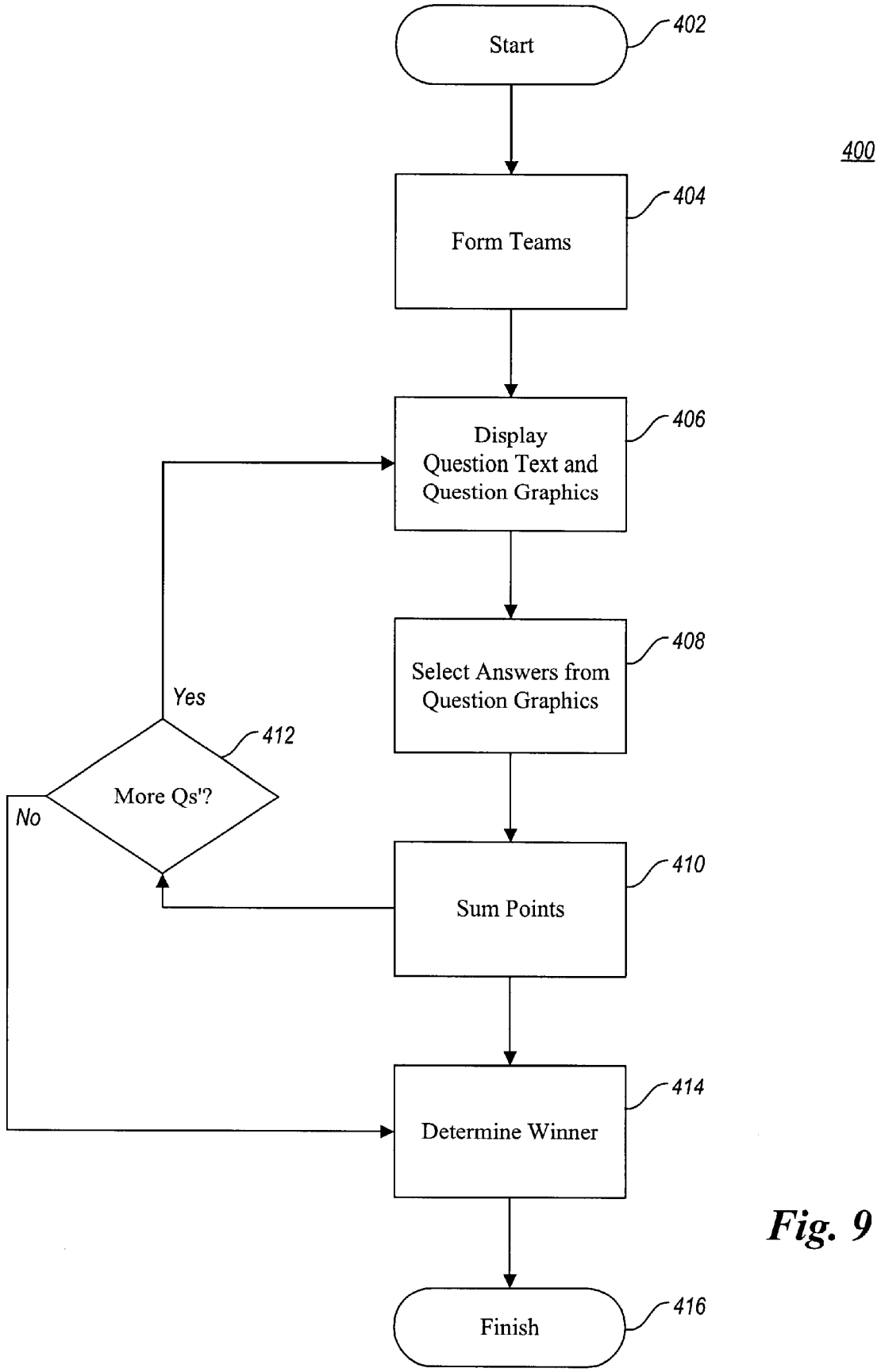
FIG. 9 is a flow diagram of a basic method of providing questions and selecting answers under the facility of FIG. 1.

The multimedia display 114 employed by one embodiment of the interactive multimedia game forms an important part of the method for playing the game under one embodiment of the invention. Referring to FIG. 9, a basic method 400 of providing questions and selecting answers according to this embodiment begins in step 402 where control immediately passes to step 404. In step 404, the players form teams. The live human host 102*a* may facilitate this.

In step 406, the multimedia display 114 displays question text and question graphics. In step 408, any of the players 108 on the teams 110 may select answers from among the question graphics. When all of question graphics that make up the overall correct multimedia answer are selected, or the time remaining runs down to zero, the basic method 400 advances to step 410.

In step 410, the points for each team are summed. In step 412, the method 400 determines whether there are any more questions to be posed to the teams 110. If there are more questions to be posed, the basic method 400 returns to step 406, which displays new question text and new question graphics. If there are no more questions as determined in step 412, then the basic method 400 advances to step 414, where a winner from among all of the teams 110 is determined. The basic method 400 is then complete, as indicated by step 416.

Figure 10B:
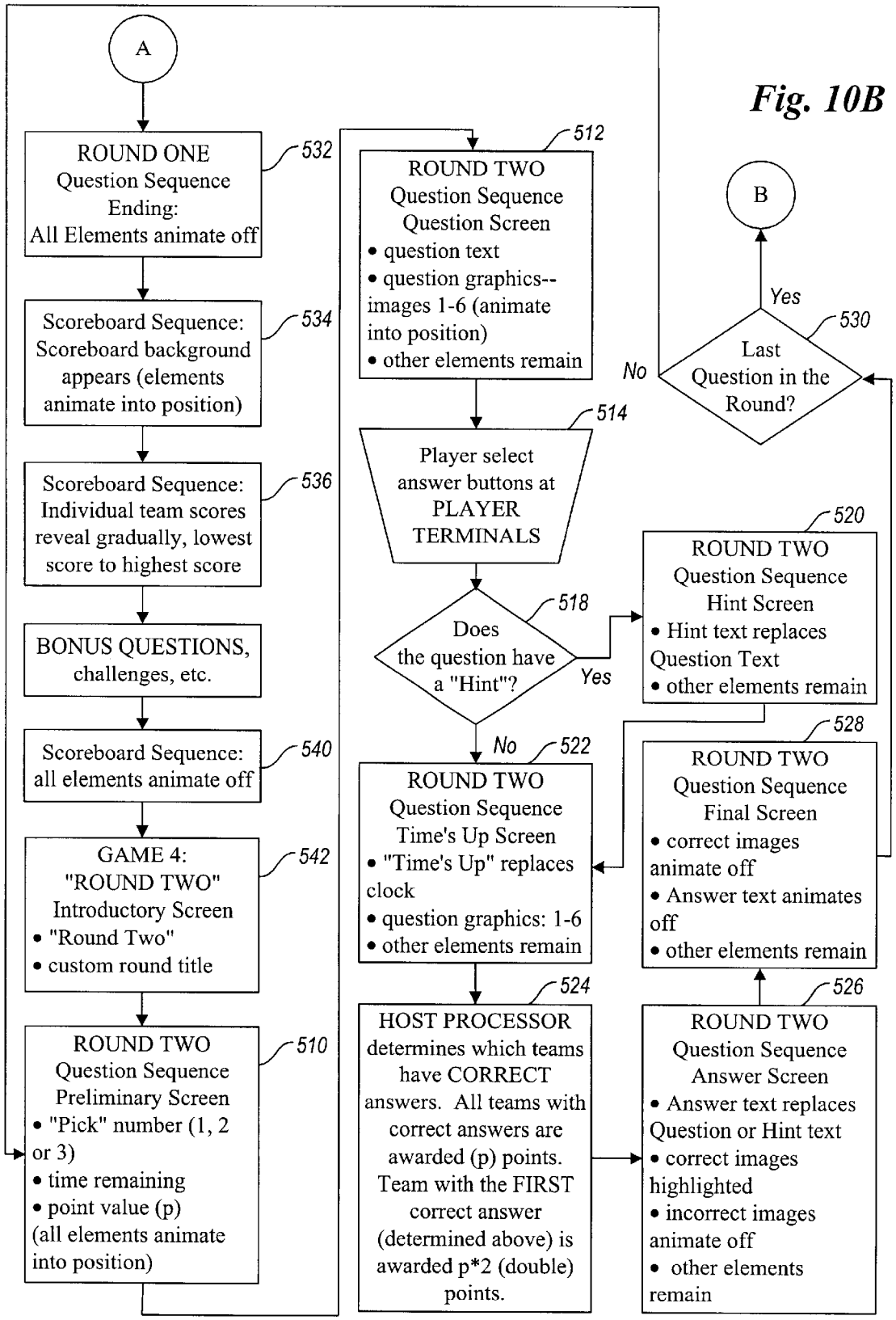
Figure 10C:
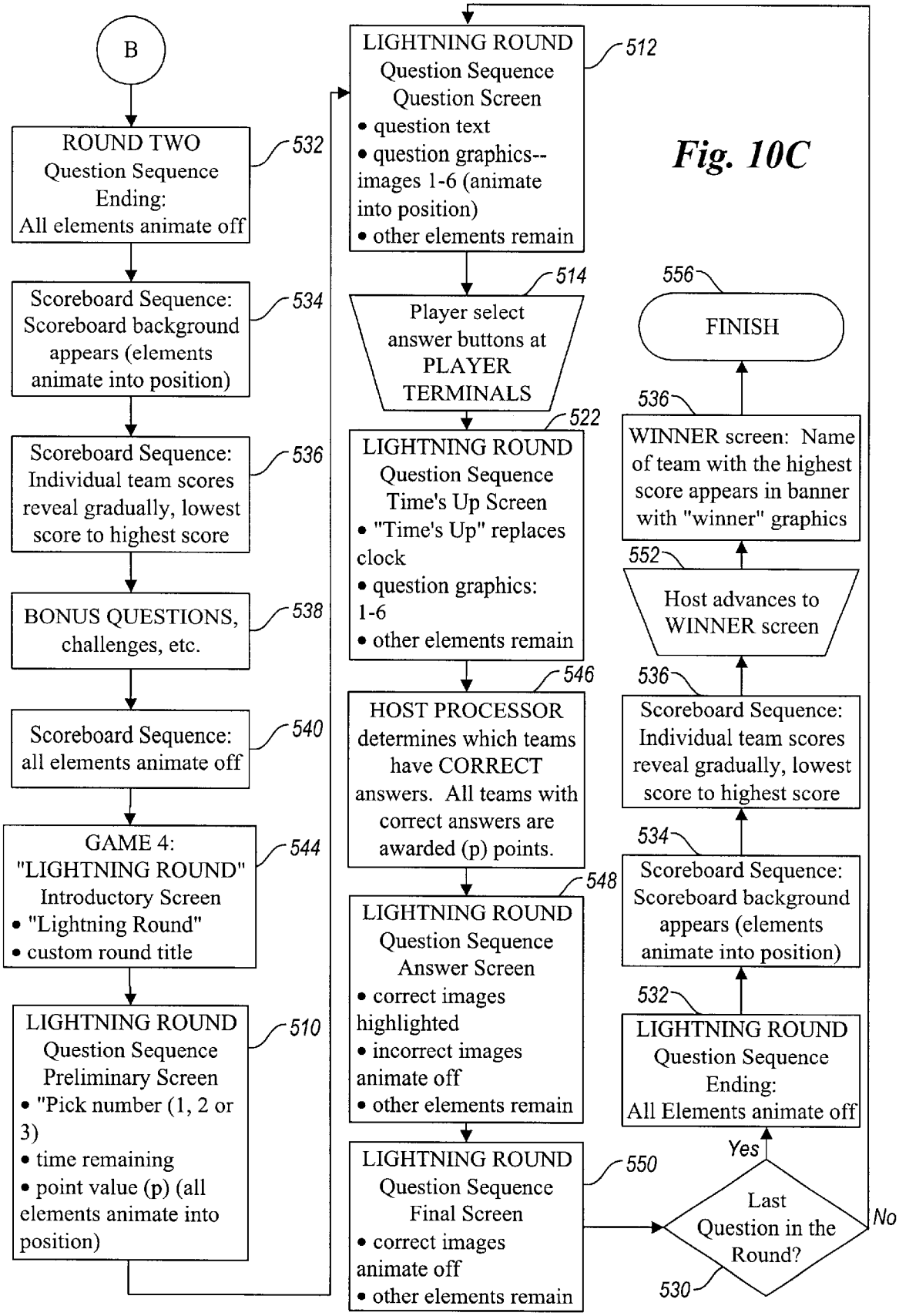

FIGS. 10A, 10B and 10C illustrate a more detailed method 500 of playing the interactive multimedia game under one embodiment of the present invention. The method 500 begins in step 502, where the players 108 enter and the host 102 facilitates organization of the players 108 into teams 110. The players may select individual unique team names.

In step 504, the human host 102*b* initiates the game in conjunction with the computer host 102*a*. At this point in the process, the players 108 enter the chosen unique team name on the text display unit 212.

In step 506, the human host 102*b* electronically enters the names of the teams 110 chosen by the individual teams 110 into the computer host 102*a*. The human host 102*b* also selects a particular game from among a plurality of games stored in the master computer system 104. In one embodiment there are ten games numbered one through nine, and the human host 102*b* selects game number 4.

Recall that the interactive multimedia game is played in rounds. Thus, in step 508, the first round begins and the multimedia system 113 plays and displays an "introductory screen." The "introductory screen" includes animated graphical elements, music, and the words "round one" in an arrangement unique to the first round. The "introductory screen" may display the words "double points for first correct multimedia answer." The multimedia system 113 also displays and plays a customized title for the particular round, in this case for round two. At this point, the human host 102*b* advances the program to the round one question sequence, and control passes to step 510.

In step 510, the multimedia system 113 displays a "preliminary screen," which includes animated graphical backgrounds as well as music. The "preliminary screen" also includes the pick number box 310, the point value box 308, and the time remaining box 306, which all animate into position on the multimedia screen 115. At this point, the human host 102*b* advances the progress of the game.

In step 512, the multimedia screen 115 displays a "question screen" which includes displaying question text in the text box 304, and displaying a plurality of question graphics 302*a*–302*f* in the question graphics box 302. The pick number box 310, the point value box 308, and the time remaining box 310 remain in place on the multimedia screen 115.

Based on the question text, the question graphics and the "pick number," the players 108 select the answers by pushing the push buttons 202 on the player terminal 112. Referring back to FIG. 4, suppose that the question text for the first question of the first round is "Dave's Burger," and that the players 108 have fifteen seconds to select one of the six question graphics in the question graphics box 302 that is identified with "Dave's Burger." As such, the players 108 must choose from the triangle as the question graphic 302*a*, the square question graphic 302*b*, the circle question graphic 302*c*, the rectangle question graphic 302*d*, the ellipse question graphic 302*e*, and the hexagon question graphic 302*f*. If the players recognize that the square depicted in the question graphic 302*b* is identified with "Dave's Burger" because the hamburgers offered at WENDY'S® restaurant are square, and WENDY'S® is owned by "Dave," then the players will so indicate. Recall that in one embodiment the array of push buttons 202 correspond to the array of question graphics in the question graphics box 302 such that the question graphics 302*a*, 302*b*, 302*c*, 302*d*, 302*e*, and 302*f* corresponds to the position of the push buttons 202*a*, 202*b*, 202*c*, 202*d*, 202*e*, and 202*f* on each player terminal 112. Thus, the player 108*a* would press the push button 202*b* to represent the question graphic 302*b*.

The computer host 102*a* then determines which team 110 has selected the first correct multimedia answer. The computer host 102*a* then determines whether the human host 102*a* desires to check the scores for the individual teams 110. If the human host 102*b* desires to check the scores, the human host 102*b* accesses the scoreboard 116. Individual team 110 scores are displayed from the highest to the lowest. The multimedia question screen is then accessed by the human host 102*b*, and control passes to step 518.

In step 518, the host 102 determines whether the multimedia question has a hint. If the multimedia question has a hint, then the human host 102*b* accesses the hint and control passes to step 520. In step 520, the text box 304 displays "hint text" to assist the players 108 in selecting correct multimedia answers. Control then passes to step 522.

On the other hand, if in step 518 it is determined that there is no hint available, control passes to step 522 wherein a "time's up" screen replaces the "question screen." The "time's up" screen includes a "time's up" clock that is displayed in the time remaining box 306. Display of the "time's up" screen in the time remaining box 306 indicates that there is no more time remaining for selecting answers to questions.

In step 524, the computer host 102*b* determines which teams 110 have selected correct multimedia answers. All teams 110 with correct multimedia answers are awarded the number of points indicated in the point value box 308. The team 110 with the first correct multimedia answer is awarded double the point value indicated in the point value box 308. At this point the program is advanced by the human host 102*b*.

In step 526, an "answer screen" is displayed by the multimedia screen 115. In this step, "answer text" replaces any "hint text" appearing as a result of step 520, or replaces any "question text" that appears as a result of step 512. The question graphics 302 associated with the correct multimedia answer are highlighted and the question graphics 302 associated with the incorrect multimedia answers animate off the screen or otherwise disappear.

In step 528, a "final screen" is displayed by the multimedia screen 113. In this step, the question graphics associated with the correct multimedia answers animate off, the answer text animates off, while the pick number box 310, the point value box 308, the time remaining box 306, and the scoreboard 116, if accessed in step 512, remain.

Step 530 determines whether the multimedia question posed in step 512 was the last question in the round. If the multimedia question posed in step 512 is the last question in the round, the method 500 returns to step 510, wherein the "preliminary screen" is again displayed. Steps 510–528 are repeated.

If, on the other hand, the multimedia question posed in step 512 is the last question in the round, then the method 500 advances to step 532, wherein the multimedia screen 115 displays an "ending screen." On the "ending screen," the multimedia display 114 animates off the question graphics box 302, the text box 304, the time remaining/time's up box 306, the point value box 308, the pick number box 310, and the scoreboard 116.

In step 534, a "scoreboard sequence" is played by the audio system 118 and displayed by the multimedia screen 115. The "scoreboard sequence" includes a displayed animated background with graphics and replayed music. It gradually reveals the unique name of each team 110 and their scores, from the lowest scoring team to the highest scoring team. One feature of the present invention is that once all scores are revealed, the human host 102*b* may add or subtract points to each team's score if desired. In step 540, all elements of the "scoreboard sequence" animate off.

Recall that the game is played in rounds. As such, the method 500 advances to round two. That is, in step 542, a round two "introductory screen" is displayed and played on the multimedia unit 113. This screen includes animated graphical elements, music, the words "round two," and the words "double points for first correct multimedia answer." The multimedia unit 113 also displays and plays a customized title for the particular round, in this case for round two. The flowchart 500 then repeats steps 510 through 540 for round two.

That is, the multimedia unit 113 again displays the "preliminary screen," but with an animated graphical backgrounds and music that are different from those of round one. The round two "preliminary screen" also includes the pick number box 310, the point value box 308, and the time remaining box 306, which all animate into position, or otherwise appear on the multimedia display 114.

The multimedia screen 115 also displays a "question screen" and a plurality of question graphics 302*a*–302*f* in the question graphics box 302. Again, based on the question text, the question graphics and the "pick number," the players 108 select the answers by pushing the push buttons 202 on the player terminal 112. Referring back to FIG. 7, suppose the question text is "Which three go together?," the players 108 have to select three of the six question graphics in the question graphics box 302 that go together, within fifteen seconds, must choose from among the spaghetti question graphic 302*a*, the poodle question graphic 302*b*, the monkeys question graphic 302*c*, the cars question graphic 302*d*, the eagles question graphic 302*e*, and the rocks question graphic 302*f*. If the players recognize that the overall correct multimedia answer is the monkeys question graphic 302*c*, the cars question graphic 302*d*, and the eagles question graphic 302*e* because they correspond to the rock groups THE MONKEES® THE CARS®, and THE EAGLES®, then the player 108*a* would press the push button 202*c*, the player 108*d* would press the push button 202*d*, and the player 108*l* would press the push button 202*e* to represent THE MONKEYS®, THE CARS®, and THE EAGLES®. The green light 208*a* may illuminate for the team 110*a* on the player terminal 112*a*.

Once the method 500 repeats steps 510 through 540 for round two of the game, the method 500 advances to a "lightning round." As such, in step 544, a lightning round "introductory sequence" is played and displayed by the multimedia unit 113. The lightning round "introductory sequence" includes animated graphical elements, music, and the words "lightning round." The lightning round "introductory sequence" also includes a customized lightning round title and text. The method 500 then repeats steps 510, 512, 514, and 522 for the lightning round.

For example, referring back to FIG. 8, suppose the question text is "Monoxide Outflow," the players 108 have to select two of the six question graphics in the question graphics box 302 that form a compound word within. fifteen seconds, and must choose from among the "gas can" question graphic 302*a*, the "baseball cap" question graphic 302*b*, the "tobacco pipe" question graphic 302*c*, the "light bulb" question graphic 302*d*, the "raccoon tail" question graphic 302*e*, and the "telephone" question graphic 302*f*. If the players recognize that the overall correct multimedia answer is the raccoon tail question graphic 302*e* and the tobacco pipe question graphic 302*c* because they form the compound word "tail pipe," then the player 108*a* would press the push button 202*c*, the player 108*d* would press the push button 202*d*, and the player 108*l* would press the push button 202*e*. A representation of a word or phrase in the form of pictures or symbols is known as a rebus, and is often presented as a puzzle. Note that if the player 108*d* presses the push button 202*d*, its an incorrect multimedia answer and no points are awarded. Moreover, if the player 108*l* presses the push button 202*e* early within in the time allotted, then the team 110*c* may receive double the point value displayed in the point value box 308 for that question. The method 500 then advances to step 546.

In step 546, the computer host 102*a* determines which teams 110 have selected correct multimedia answers. The teams 110 with the overall correct multimedia answer is awarded the number of points displayed in the point value box 308.

In step 548, a "lightning round answer screen" is displayed on the multimedia display 114. The correct question graphics are highlighted, the incorrect question graphics animate off or disappear, while the time remaining/time's up box 306, the point value box 308, the pick number box 310, and the scoreboard 116 remain displayed by the multimedia display 114.

In step 550, a "lightning round final screen" is displayed on the multimedia display 114. The correct question graphics highlighted in step 548 now animate off or otherwise disappear. The time remaining/time's up box 306, the point value box 308, the pick number box 310, and the scoreboard 116 remain.

The method 500 then repeats steps 532, 534, and 536 for the "lightning round." Because the "lightning round" is the last round to be played in the game, a winner is chosen following the "lighting round."

In step 552, the host 102 advances to a "winner screen." The "winner screen" features animated graphics and music. The "winner screen" also displays the final point total and the unique name for the winning team 110. As indicated by step 554, the name of the winning team 110 appears in a banner with the words "winner" and other suitable graphics. The winning team 110 is also awarded prizes. The method 500 is then complete, as indicated by step 556.

III. Conclusion

Although specific embodiments of, and examples for, the present invention are described herein for illustrative purposes, various equivalent modifications are possible within the scope of the invention, as will be recognized by those skilled in the relevant art. The teachings provided herein of the present invention can be applied to other location-based entertainment facilities, not necessarily the exemplary location-based facility described above. For example, the teachings provided herein can be applied to games that accommodate more or fewer rounds, games in which the multimedia question elements are sequenced differently, etc. Alternatively, the games may be fully automated, i.e., a human host is not required for this invention.

The game may be played by more that two players using one computer or several computers networked together. For example, the players all may be patrons of the location-based entertainment facility. Alternatively, some of the players may be patrons of the location-based entertainment facility while other players may be playing the interactive multimedia game via an Internet connection between the worldwide web and the location-based facility. Alternatively still, some of the players may be playing the interactive multimedia game via a television connection between their homes and the location-based facility. The interactive multimedia game may also be played in "cyberspace" via the Internet or similar computer network, without a location-based facility.

These and other changes can be made to the invention in light of the above-detailed description. In general, in the following claims, the terms used should not be construed to limit the invention to the specific embodiment disclosed in the specification and claims, but should be construed to include all location-based entertainment facilities that operate under the claims to provide a system and method for an electronically interactive multimedia game.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A computer-readable medium whose contents cause a computer system to conduct an interactive multimedia game by:

displaying a first set of at least three possible multimedia answers, wherein at least two of the possible multimedia answers from the first set of possible multimedia answers are correct answers because the combination forms a rebus;

receiving a signal from a first player terminal, where the signal corresponds to selections by one or more players at the first player terminal of at least two of the possible multimedia answers in the first set of possible multimedia answers; and determining from the received signal if the multimedia answers selected by the one or more players at the first player terminal are the correct answers that form the rebus.

2. The computer-readable medium of claim 1 whose contents cause the computer system to conduct the interactive multimedia game further by:

identifying to the one or more players at the player terminal which of the possible multimedia answers in the first set of possible multimedia answers form the rebus, only after receiving the signal from the first player terminal.

3. The computer-readable medium of claim 1 whose contents cause the computer system to conduct the interactive multimedia game further by:

providing an indication of the number of the possible multimedia answers in the first set of possible multimedia answers that are the correct answers before receiving the signal from the first player terminal.

4. The computer-readable medium of claim 1 whose contents cause the computer system to conduct the interactive multimedia game further by:

providing a multimedia hint prior to displaying the first set of possible multimedia answers.

5. The computer-readable medium of claim 1 whose contents cause the computer system to conduct the interactive multimedia game further by:

displaying a visual indication indicating whether the one or more players at the first player terminal selected each of the correct answers.

6. The computer-readable medium of claim 1 whose contents cause the computer system to conduct the interactive multimedia game further by:

displaying a visual indication indicating whether the one or more players at the first player terminal selected each of the correct answers in a correct order.

7. The computer-readable medium of claim 1 wherein at least one of the possible answers in the first set of possible multimedia answers is incorrect.

8. The computer-readable medium of claim 1 whose contents cause the computer system to conduct the interactive multimedia game further by:

receiving a signal from a second player terminal, where the signal corresponds to selections by one or more players at the second player terminal of the possible multimedia answers in the first set of possible multimedia answers.

9. A computer readable medium whose contents cause a computer system to conduct an interactive multimedia game by:

displaying a first set of at least three non-identical possible multimedia answers where at least two of the possible multimedia answers in the first set of possible multimedia answers are related to one another, each of the related possible multimedia answers being a correct answer;

receiving a signal from a first player terminal, where the signal corresponds to selections by one or more players at the first player terminal of at least one of the possible multimedia answers in the first set of possible multimedia answers; and determining from the received signal if the multimedia answers selected by the one or more players at the first player terminal are the correct answers that are related.

10. The computer-readable medium of claim 9 whose contents cause the computer system to conduct the interactive multimedia game further by:

providing an indication of the number of the possible multimedia answers in the first set of possible multimedia answers that are the correct answers before receiving the signal from the first player terminal.

11. The computer-readable medium of claim 9 whose contents cause the computer system to conduct the interactive multimedia game further by:

displaying a multimedia hint prior to displaying the first set of possible multimedia answers.

12. The computer-readable medium of claim 9 whose contents cause the computer system to conduct the interactive multimedia game further by:

displaying a multimedia hint in the form of a category that defines the relation between the correct answers prior to displaying the first set of possible multimedia answers.

13. The computer-readable medium of claim 9 whose contents cause the computer system to conduct the interactive multimedia game further by:

displaying a visual indication indicating the number of the correct answers selected by the one or more players at the first player terminal.

14. The computer-readable medium of claim 9 whose contents cause the computer system to conduct the interactive multimedia game further by:

determining from the received signal if the multimedia answers selected by the one or more players at the first player terminal were selected in a correct order.

15. A computer readable medium whose contents cause a computer system to conduct an interactive multimedia game by:

displaying a first set of at least three non-identical possible multimedia answers where at least two of the possible multimedia answers in the first set of possible multimedia answers are related to one another, each of the non-related possible multimedia answers being a correct answer;

receiving a signal from a first player terminal, where the signal corresponds to selections by one or more players at the first player terminal of at least one of the possible multimedia answers in the first set of possible multimedia answers; and determining from the received signal if the multimedia answers selected by the one or more players at the first player terminal are the correct answers that are not related.

16. The computer-readable medium of claim 15 whose contents cause the computer system to conduct the interactive multimedia game further by:

providing an indication of the number of the possible multimedia answers in the first set of possible multimedia answers that are the correct answers before receiving the signal from the first player terminal.

17. The computer-readable medium of claim 15 whose contents cause the computer system to conduct the interactive multimedia game further by:

displaying a multimedia hint prior to displaying the first set of possible multimedia answers.

18. The computer-readable medium of claim 15 whose contents cause the computer system to conduct the interactive multimedia game further by:

displaying a multimedia hint in the form of a category prior to displaying the first set of possible multimedia answers.

19. The computer-readable medium of claim 15 whose contents cause the computer system to conduct the interactive multimedia game further by:

displaying a visual indication indicating the number of correct answers selected by the one or more players at the first player terminal.

20. The computer-readable medium of claim 15 whose contents cause the computer system to conduct the interactive multimedia game further by:

determining from the received signal if the multimedia answers selected by the one or more players at the first player terminal were selected in a correct order.

21. A computer readable medium whose contents cause a computer system to conduct an interactive multimedia game by:

displaying a multimedia question;

displaying a first set of at least two non-identical possible multimedia answers where at least one of the possible multimedia answers in the first set of possible multimedia answers is a graphic representation cognitively associable to a lingual answer to the multimedia question, each of the possible multimedia answers cognitively associable to the lingual answer to the multimedia question being a correct answer;

receiving a signal from a first player terminal, where the signal corresponds to selections by one or more players at the first player terminal of at least one of the possible multimedia answers in the first set of possible multimedia answers;

providing an indication of the number of the possible multimedia answers in the first set of possible multimedia answers that are the correct answers, before receiving the signal from the first player terminal; and determining from the received signal if the multimedia answers selected by the one or more players at the first player terminal are the correct answers that are cognitively associable to the lingual answer to the multimedia question.

22. The computer-readable medium of claim 21 wherein displaying a multimedia question includes displaying a description of a category into which at least one of the possible multimedia answers in the first set of possible multimedia answers belongs.

23. A method of playing an interactive multimedia game in a location-based entertainment facility, comprising:

displaying a first set of at least two non-identical possible multimedia answers to a plurality of teams where each of the teams includes at least two players;

providing an indication of the number of the possible multimedia answers in the first set of possible multimedia answers that are correct answers;

receiving from each of the teams within a single determined time period, at least one of the possible multimedia answers selected by the at least two players on the team; and for each of the teams, determining if the possible multimedia answers selected from the first set of possible multimedia answers are the correct answers.

24. The method of claim 23, further comprising:

providing a multimedia hint prior to displaying the first set of possible multimedia answers.

25. The method of claim 23, further comprising:

automatically preventing each of the teams from selecting more of the possible multimedia answers than the number of correct answers.

26. The method of claim 23 wherein at least two of the possible multimedia answers from the first set of possible multimedia answers are correct answers because the combination of the possible multimedia answers form a rebus.

27. The method of claim 23 wherein at least two of the possible multimedia answers in the first set of possible multimedia answers are related to one another, each of the related possible multimedia answers being one of the correct answers.

28. The method of claim 23 wherein at least two of the possible multimedia answers in the first set of possible multimedia answers are related to one another, each of the non-related possible multimedia answers being a correct answer.

29. The method of claim 23 wherein at least one of the possible multimedia answers in the first set of possible multimedia answers is related the multimedia question, each of the related possible multimedia answers being a correct answer.

* * * * *